US008657011B2

(12) United States Patent
Vyas et al.

(10) Patent No.: US 8,657,011 B2
(45) Date of Patent: Feb. 25, 2014

(54) UNDERWATER POWER GENERATION

(75) Inventors: Parag Vyas, Munich (DE); Matthew Alexander Lehar, Munich (DE); Ashalatha Devarajan, Bangalore (IN); Peter John Davey, Somerset (GB); Nicholas Ellson, Bristol (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 555 days.

(21) Appl. No.: 12/968,355

(22) Filed: Dec. 15, 2010

(65) Prior Publication Data

US 2011/0143175 A1 Jun. 16, 2011

(30) Foreign Application Priority Data

Dec. 15, 2009 (GB) ..... 0921858.7

(51) Int. Cl.
*E21B 7/12* (2006.01)

(52) U.S. Cl.
USPC ..... 166/335; 166/344; 166/351; 166/352

(58) Field of Classification Search
USPC ..... 166/335, 344, 351, 352, 65.1; 60/748, 60/801
See application file for complete search history.

(56) References Cited

U.S. PATENT DOCUMENTS 3,342,267 A * 9/1967 Cotter et al. ..... 166/60
3,568,140 A 3/1971 Allen et al.
4,112,687 A 9/1978 Dixon
4,250,230 A * 2/1981 Terry ..... 429/444
4,607,701 A * 8/1986 Gundersen ..... 166/368
4,629,537 A * 12/1986 Hsu ..... 429/535
4,781,029 A 11/1988 Servaas
5,839,508 A * 11/1998 Tubel et al. ..... 166/65.1
6,063,515 A * 5/2000 Epp et al. ..... 429/411
6,072,303 A * 6/2000 Nickoladze et al. ..... 322/20
6,150,601 A * 11/2000 Schnatzmeyer et al. ..... 136/201
6,253,847 B1 * 7/2001 Stephenson ..... 166/248
6,575,248 B2 * 6/2003 Zhang et al. ..... 166/338
6,998,724 B2 * 2/2006 Johansen et al. ..... 290/1 R
7,069,998 B2 * 7/2006 Zhang et al. ..... 166/338
7,096,955 B2 * 8/2006 Zhang et al. ..... 166/338
8,033,328 B2 * 10/2011 Hall et al. ..... 166/65.1
8,035,244 B2 * 10/2011 Sutherland ..... 290/54

(Continued)

FOREIGN PATENT DOCUMENTS

GB 1595528 A 8/1981
GB 2266546 A 11/1993

(Continued)

OTHER PUBLICATIONS

Wikipedia, "Flow battery", Sep. 25, 2009, entire article.

(Continued)

*Primary Examiner* — Matthew Buck
*Assistant Examiner* — Aaron Lembo
(74) *Attorney, Agent, or Firm* — Global Patent Operation

(57) ABSTRACT

A method for providing auxiliary electrical power to an underwater well installation, the installation being linked to a surface location via an umbilical cable, to supplement any electrical power received at the installation from the umbilical cable, comprises the steps of: providing power generation means at the installation; and providing an electrical power output line for transferring electrical power generated by the power generation means to the installation.

13 Claims, 3 Drawing Sheets

(56) References Cited

U.S. PATENT DOCUMENTS

| | | | | |
|---|---|---|---|---|
| 8,322,447 | B2 * | 12/2012 | Loretz et al. | 166/374 |
| 8,375,716 | B2 * | 2/2013 | Ramaswamy et al. | 60/641.2 |
| 8,390,137 | B2 * | 3/2013 | Bryfogle | 290/1 R |
| 8,421,251 | B2 * | 4/2013 | Pabon et al. | 290/1 R |
| 8,421,287 | B2 * | 4/2013 | Hall et al. | 310/87 |
| 8,426,988 | B2 * | 4/2013 | Hay | 290/1 R |
| 2003/0102720 | A1 * | 6/2003 | Baggs et al. | 307/149 |
| 2005/0179263 | A1 | 8/2005 | Johansen et al. | |
| 2006/0006656 | A1 | 1/2006 | Smedstad | |
| 2006/0016606 | A1 | 1/2006 | Tubel et al. | |
| 2009/0151956 | A1 * | 6/2009 | Johansen et al. | 166/350 |
| 2009/0260358 | A1 | 10/2009 | Rapp et al. | |
| 2012/0175125 | A1 * | 7/2012 | Krohn et al. | 166/344 |
| 2013/0113213 | A1 * | 5/2013 | Yarnold et al. | 290/50 |

FOREIGN PATENT DOCUMENTS

| | | | |
|---|---|---|---|
| WO | 97/23708 | A1 | 7/1997 |
| WO | 2005/078233 | A1 | 8/2005 |
| WO | 2007/072200 | A2 | 6/2007 |
| WO | 2009/122174 | A1 | 10/2009 |

OTHER PUBLICATIONS

GB0921858.7/ Search Report, dated Mar. 11, 2010.

Stavropoulos, Michael et al, "Subsea Electrical Power Generation for Localized Subsea Applications", Offshore Technology Conference 15366, May 5-8, 2003, Houston, Texas, pp. 1-8.

* cited by examiner

UNDERWATER POWER GENERATION

BACKGROUND OF THE INVENTION

1. Field of the Invention

This invention relates to a method of providing electrical power at an underwater installation, a method for providing auxiliary electrical power to an underwater well installation, the installation being linked to a surface location via an umbilical cable, to supplement any electrical power received at the installation from the umbilical cable, an underwater well installation and a facility including such an installation.

2. Description of the Prior Art

Underwater installations, for example subsea hydrocarbon extraction wells and well fields having a number of such wells, are typically supplied with electric power from a surface or land-based source via insulated copper cores within an umbilical cable. Typically, such umbilicals also carry hydraulic power lines, enabling certain control functionality at the well, and chemical flow lines for servicing the well.

As an umbilical ages, the insulation around the copper cores may degrade, for example through water ingress or chemical degradation. The cores themselves may also degrade. Such degradation may result in a reduction in the capacity of the cores to transmit electricity so that the well is unable to function adequately. Currently, the only solution to this problem is to replace the umbilical, which is very expensive.

Additionally, it is often the case that fields developed in the past reach the end of the infrastructure's design life, but may still be capable of producing hydrocarbons. Operators may therefore need to upgrade the infrastructure to extend the field life. The upgraded infrastructure usually has a higher power consumption than the original development, for example due to the need for more sensors for monitoring ageing equipment, increased electronics generally and more measurements of produced fluid due to changes etc.

The original umbilical will have been designed to cater for the original power requirements, and so may be inadequate for the upgraded equipment. The operators are then faced with the choice of either replacing the umbilical, which as noted above is very costly, or limiting the amount of equipment placed subsea, which is commercially undesirable.

Systems having forms of underwater power generation are known from US 2006/0006656, US 2005/0179263, WO2009/122174, GB 1595529, U.S. Pat. No. 4,112,687, WO 97/23708, US 2006/016606, XP002532127 (OTC 15366, 5 May 2003, pp 1-8), U.S. Pat. Nos. 4,781,029 and 3,568,140.

It is an aim of this invention to address the problems described above. In particular, the invention provides a much cheaper alternative to the drastic solution of replacing the umbilical, and allows upgrading without limitations. This aim is achieved by providing auxiliary power generation means at the installation, to supplement the power received at the installation from the umbilical. In a particular embodiment, the auxiliary power generation means comprises a chemical flow battery.

Using the invention, either or both of the voltage and current carried by the umbilical cable can be increased to meet demands of well tree equipment.

SUMMARY OF THE INVENTION

In accordance with the a first aspect of the present invention there is provided a method for providing auxiliary electrical power to an underwater well installation, the installation being linked to a surface location via an umbilical cable, to supplement any electrical power received at the installation from the umbilical cable, comprising the steps of: providing power generation means at the installation; and providing an electrical power output line for transferring electrical power generated by the power generation means to the installation.

In accordance with a second aspect of the present invention there is provided a method of providing electrical power at an underwater installation, comprising the steps of: providing a chemical flow battery at the installation; providing a chemical supply channel for supplying the flow battery with operating chemicals for the purpose of electrical power generation; and providing an electrical power output line for transferring electrical power generated by the flow battery to the installation.

In accordance with a third aspect of the present invention there is provided a method for providing auxiliary electrical power to an underwater well installation, the installation being linked to a surface location via an umbilical cable, to supplement any electrical power received at the installation from the umbilical cable, comprising the steps of: providing a chemical flow battery at the installation; providing a chemical supply channel for supplying the flow battery with operating chemicals for the purpose of electrical power generation, the chemical supply channel comprising a flowline housed within the umbilical cable; and providing an electrical power output line for transferring electrical power generated by the flow battery to the installation.

In accordance with a fourth aspect of the present invention there is provided an underwater well installation comprising a chemical flow battery.

In accordance with a fifth aspect of the present invention there is provided a facility comprising an underwater well installation in accordance with the fourth aspect, a surface location, and an umbilical cable linking the surface location and installation, the umbilical cable being arranged for supplying electrical power to the installation and providing operating chemicals to the flow battery from the surface location.

BRIEF DESCRIPTION OF THE DRAWINGS

The invention is described with reference to the accompanying figures, of which.

DETAILED DESCRIPTION OF THE INVENTION

Figure 1:
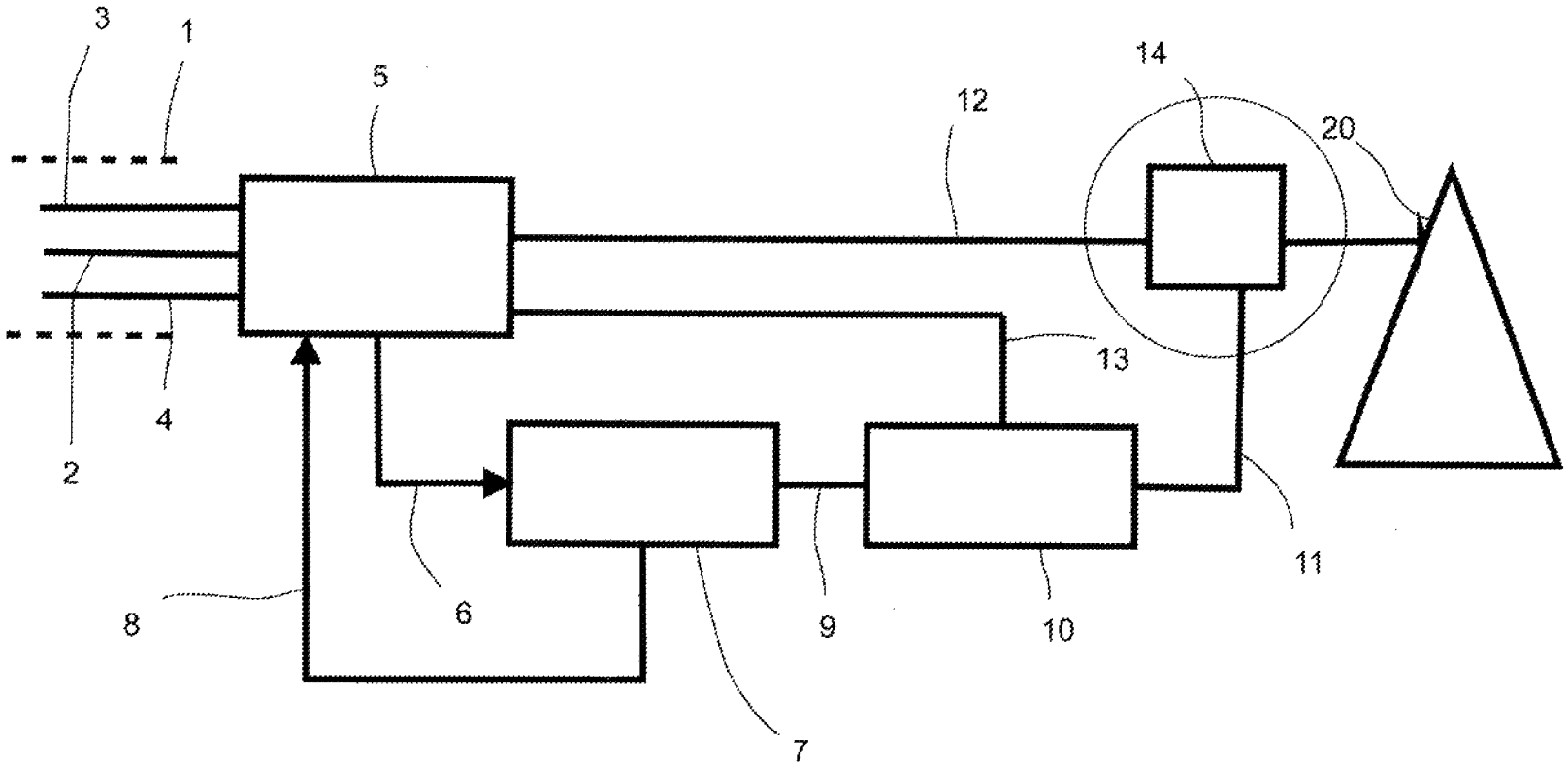
FIG. 1 schematically shows a first embodiment of the invention with an arrangement to increase the current and/or voltage supplied to a well.

FIG. 1 schematically shows a first embodiment of the present invention, configured for use where the electric current and/or voltage supplied from a surface location to a subsea well installation via an umbilical cable 1 has been limited to less that the well field requirement, for example due to degradation of the copper cores of the umbilical 1, or increased requirements of updated well equipment.

Umbilical cable 1 is shown carrying three different lines: an electrical power line 2 which generally carries AC current to the installation, and two chemical flow lines 3, 4. Typically there will be various other lines present, for example hydraulic control lines, other electrical and chemical lines, which are not shown here for clarity. In an advantageous embodiment, either or both of the chemical flow lines 3, 4 may comprise spare lines, such as disused hydraulic fluid lines in the umbilical, i.e. lines which were originally intended to carry hydraulic fluid between the surface and the installation. Such an arrangement assists in retrofitting the present invention to existing systems. Other spare lines, for example spare chemical supply lines, may also be used.

The umbilical 1 terminates subsea at an umbilical termination assembly (UTA) 5, which may be located at various locations at the installation, for example at a well head if this is serviced individually, or at a central location if a field of wells is to be serviced.

The electrical power line 2 provides power to a well tree 20 via the UTA 5 and an electrical line 12, as well as a transformer 14 as will be described later. The chemical flow line 3 acts as a chemical supply channel to supply operating chemicals for a chemical flow battery 7, while, in this embodiment, the flow line 4 acts as a chemical removal or return channel for returning spent chemicals from the flow battery 7 to the surface. Flow lines 6 and 8 are provided for carrying operating chemicals to, and spent chemicals from the flow battery 7 respectively. Both these lines 6 and 8 connect between the UTA 5 and battery 7.

In this embodiment, the spent chemicals used by the flow battery are returned to the UTA 5 via line 8 and back to the surface location through a spare tube 4 in the umbilical 1. The spent chemicals may be recharged at the surface location and returned to the flow battery subsequently.

The operating chemicals used by the flow battery 7 typically comprise dissolved electroactive species in an electrolyte, with the battery 7 comprising an electrochemical cell (not shown) to convert chemical energy into electrical energy.

When operating chemicals are supplied to flow battery 7, it generates a DC output which is passed to an electronic inverter 10 via connection 9. The inverter 10 converts the DC input to AC. The AC output is automatically phased with the umbilical's AC supply, using phase information obtained via signal line 13. In more detail, the inverter internal control electronics monitor, via line 13, the umbilical's AC supply, and adjust the inverter frequency and output phase to exactly match that of the umbilical's AC supply. The output voltage is maximised, the voltage possible being dependent on the supply voltage and current available from the flow battery 7. Only when this has been achieved is the inverter output switched to the output connection. The output from inverter 10 is connected to transformer 14 via connection 11.

Figure 2A:
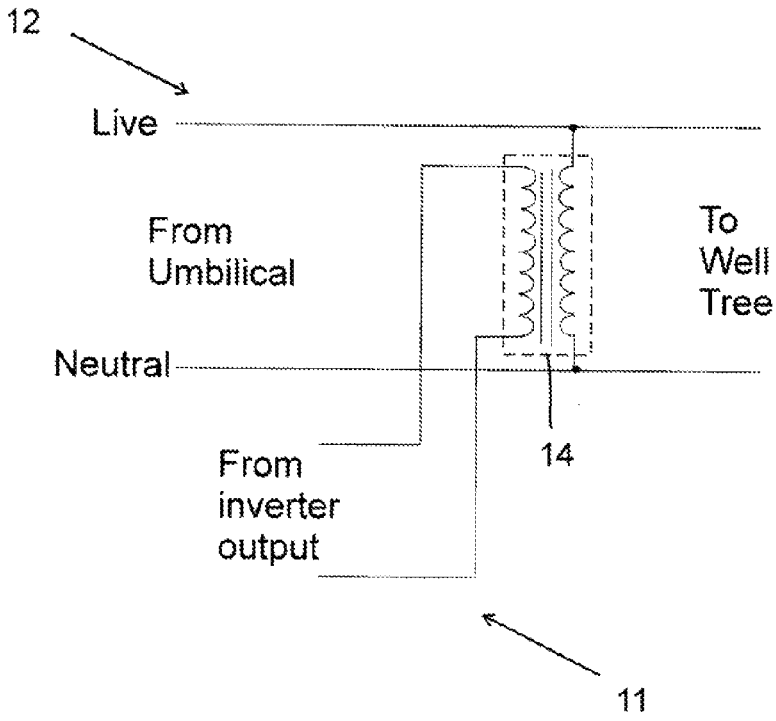
FIG. 2*a* schematically shows an enlarged view of part of the apparatus of FIG. 1 configured to increase the current supplied to a well.

FIG. 2*a* shows the transformer 14 connections in enlarged view (i.e. it shows a zoomed-in view of the circled area in FIG. 1). In the embodiment shown, the connections are set up to provide additional current to the well tree 20. Here it can be seen that the outputs from inverter 10 and umbilical 1 are effectively connected in parallel. One set of windings of the transformer 14 is in series with the inverter 10's output, while the other set of windings is across the umbilical 1's output. The two sets of windings are substantially balanced. In this way the output current from the inverter 10 supplements the current from the umbilical 1, such that the current fed to the well tree 20 is greater than either of these individual input currents.

Figure 2B:
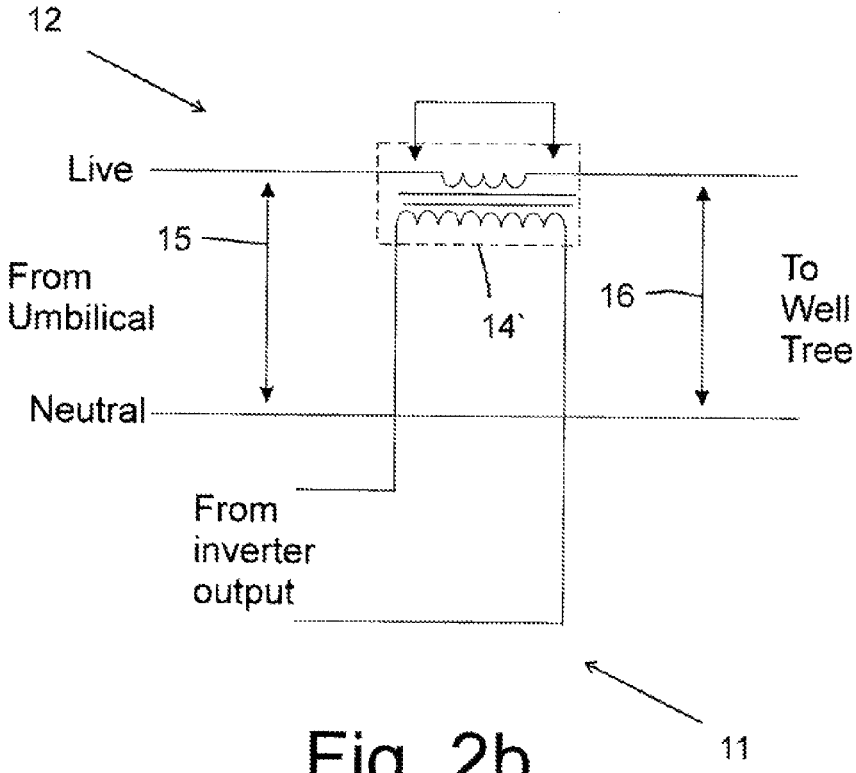
FIG. 2*b* schematically shows an enlarged view of part of the apparatus of FIG. 1 configured to increase the voltage supplied to a well.

FIG. 2*b* shows an alternative configuration to FIG. 2*a*, where the connections are set up to provide additional voltage to the well tree 20. Here it can be seen that the outputs from inverter 10 and umbilical 1 are effectively connected in series, and in phase with the umbilical supply. One set of windings of the transformer 14' is in series with the inverter 10's output, while the other set of windings is in series with the umbilical 1's output. The transformer 14' is unbalanced, so that there is a greater number of windings in series with the inverter output than the umbilical output. Using this configuration, the voltage 16 output to the well tree 6 is raised to greater than the input voltage 15 received from the umbilical.

If both the voltage and current required by the well tree 20 are greater than that output by the umbilical 1, then a configuration may be employed which includes both the configurations of FIGS. 2*a* and 2*b*, i.e. two inverters and transformers could be employed.

Figure 3:
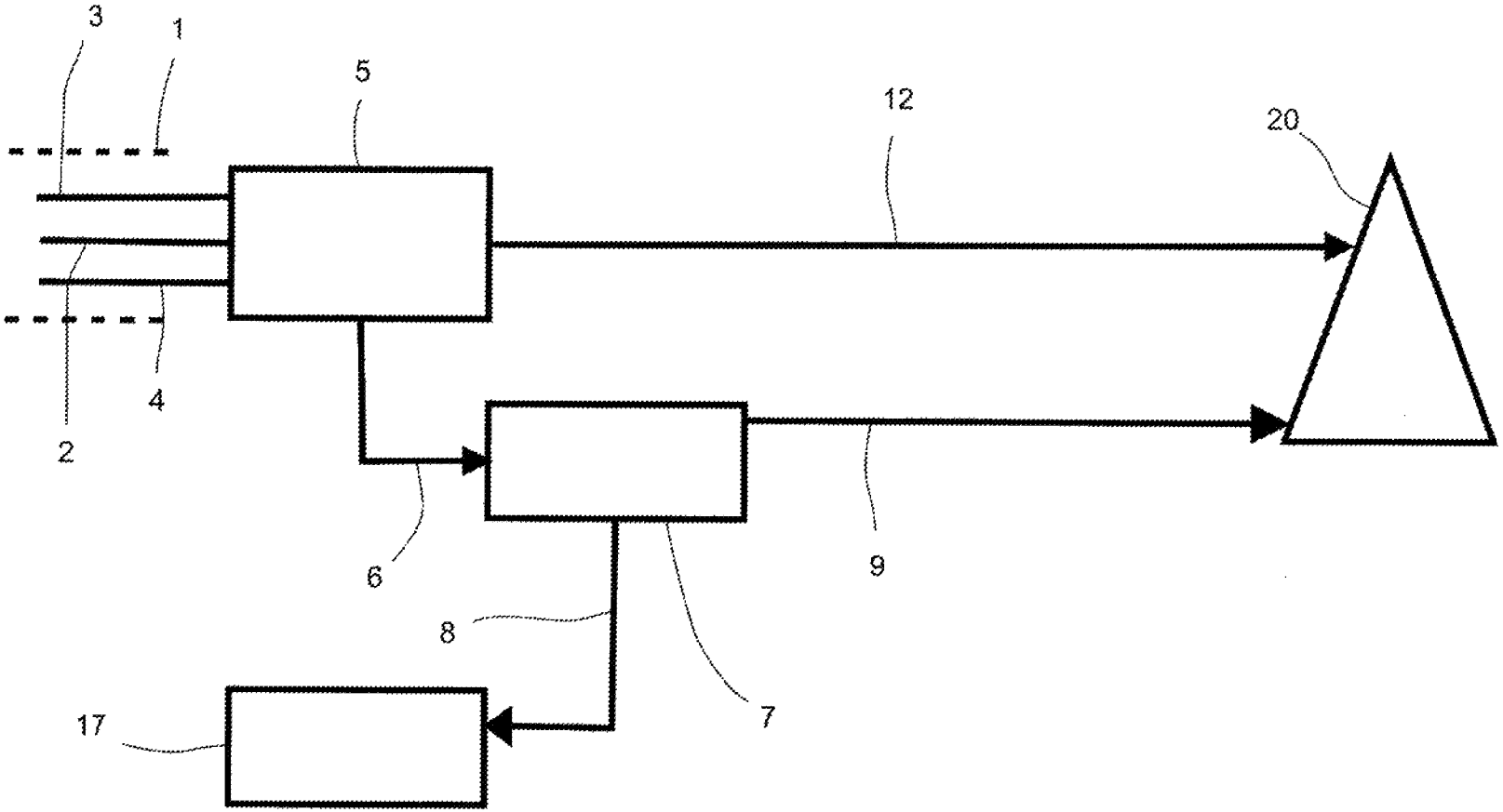
FIG. 3 schematically shows another embodiment of the invention with an arrangement for providing electrical power directly to well equipment.

FIG. 3 schematically shows another embodiment of the invention with an arrangement for providing DC electrical power directly to equipment at the well tree 20.

The arrangement shown has, in the main, similar components to those of FIG. 1, and need not be described further. The main difference is that the DC output from the flow battery 7 is sent directly to components (not shown) of the well tree 20, i.e. no inverter or transformer is required. Of course, standard electrical components (not shown), e.g. resistance networks, may be used to ensure that the current and voltage supplied by the flow battery are suitable for the well tree components concerned.

In addition, FIG. 3 also shows an arrangement whereby the spent chemicals used by the flow battery 7 are not directly returned to the surface, but instead are fed to and stored within a storage tank 17 located underwater. This tank 17 may be emptied periodically, or returned to the surface as required.

The above-described embodiments are exemplary only, and various alternatives are possible within the scope of the claims.

The automatic phasing of the AC output from inverter 10 with umbilical's AC supply may be achieved in a different manner from that described above. For example, instead of using a dedicated monitoring line 13, the internal control electronics of the inverter 10, which are powered by a DC source, may "look at" the output AC connection and adjust the inverter frequency accordingly to match that of the umbilical's supply. When this has been achieved, the inverter output may then be switched to the output connection, such that the AC inverter output is now connected to the umbilical's AC supply. The internal control electronics now adjusts the inverter output voltage and phase to maximise the in-phase output current from the inverter, which is dependent on the supply voltage and current available from the DC source.

The lines within the umbilical cable used for the operating or spent chemicals may be dedicated lines, or alternatively may be spare lines (for example unused chemical or hydraulic fluid lines).

While the embodiments specifically described show arrangements whereby the spent chemicals used by the flow battery are either returned to the surface or stored underwater, it may be possible to vent these out to the surrounding water, should this be environmentally acceptable. A further alternative is to dispose of the spent chemicals down a local water injection well.

The underwater system may use a combination of battery set-ups e.g. those shown in FIGS. 2*a*, 2*b* and 3. These can be arranged using one single battery which is electrically switched between routes, or separate batteries with dedicated routes, or a combination of these. The or each battery could be used in conjunction with other power generating sources, for example ocean current-driven turbines.

The battery and/or UTA may be located at various positions within an underwater installation, for example at a well tree, manifold, dedicated module etc.

While the embodiments described above focus on instances where an aged umbilical is inadequate for purpose, the use of flow batteries is not limited to these situations, and may be employed as a matter of course at underwater installations, for example to provide back-up or emergency power in the event of a fault. Likewise, the battery could be used to power a variety of different underwater components, whether located at a well head or not.

In an alternative embodiment, an existing chemical injection line may be used as the chemical supply channel for the flow battery. In this case, the operating chemicals for the flow battery may be combined, for example at the surface location, with a further chemical needed for operation of the installation, so that these chemicals are supplied to the installation together within the same line. Example of such further chemicals are mono ethylene glycol (MEG) and methanol, which are widely used for servicing wells. In this case, the combined chemical fluid may flow through the flow battery and then be injected into the production fluid (i.e. oil or gas) produced by the well. This is sent to the surface along a standard production fluid return line, with the components separated at the surface as appropriate.

The above-described embodiments all relate to the use of flow batteries. However, alternative power generation means may be employed at the underwater installation in order to supplement the power received from the umbilical. Such power generation means include:

Thermoelectric Power Generation

Production fluid from a hydrocarbon well is typically at a greater temperature than the water proximate the installation, due to geothermal heating. This elevated temperature may be used to obtain electrical power. Such generation may involve a Rankine cycle process for example. Here, supercritical carbon dioxide ($CO_2$) may be used as a working fluid, with seawater as a heat sink. The carbon dioxide may be heated through contact with the production fluid (e.g. oil or gas) pipeline wall and passed through an expansion-condensing cycle as is known in the art. Suitable expanders include screw-type expanders or radial inflow turbines for example. Alternatively, an organic Rankine cycle process could be employed, using an organic working fluid in place of the carbon dioxide. Suitable fluids include for example R-134a, R-245fa, propane, butane and pentane. In a further alternative, multiple Rankine cycles could be installed. This would allow a replacement to be turned on in case of a failure of the principal system, i.e. thus providing a back-up system.

Alternatively, a solid-state thermoelectric generator could be used as the power generation means, generating power using the known Seebeck effect reliant on solid state temperature differentials. Here again, production fluid could be used to provide elevated heating of a portion of the solid state material, while seawater may be used as a heat sink.

Kinetic Power Generation

An alternative or auxiliary power source may comprise energy derived from water turbines located at the installation. These could be utilised to convert hydrokinetic energy from water current flows to electrical energy in a known-manner, again to supplement electrical power supplied from the umbilical cable. Power may also be obtained from tidal movements or surface waves for example. These methods all suffer from a potential drawback in that the energy produced may be subject to fluctuation. A further alternative, which would produce a more constant supply of energy, would be to position a turbine within the produced fluid flow.

In a further embodiment, the electrical power produced at the installation may be stored locally at the installation, for example using a fuel cell, battery, capacitor or the like. In this way, problems associated with inconstant energy production may be mitigated. In addition, energy may be stored until it is needed, which may be of particular benefit where the energy demands of the installation are variable.

The use of other power generation means is also envisaged.

What is claimed is:

1. A method for providing auxiliary electrical power to an underwater well installation, the installation being linked to a surface location via an umbilical cable, to supplement any electrical power received at the installation from the umbilical cable, the method comprising:

providing a chemical flow battery at the installation;

providing a chemical supply channel for supplying the flow battery with operating chemicals for the purpose of electrical power generation, the chemical supply channel comprising a flowline housed within the umbilical cable;

supplying the operating chemicals to the flow battery via the chemical supply channel; and providing an electrical power output line for transferring electrical power generated by the flow battery to the installation, wherein the electrical power generation is caused by a chemical reaction of the operating chemicals.

2. A method according to claim 1, wherein the chemical supply channel comprises a spare chemical or hydraulic fluid flowline.

3. A method according to claim 1, further comprising mixing the flow battery operating chemicals with a further chemical at the surface location, wherein the chemical supply channel comprises a chemical injection line in the umbilical cable for transporting the further chemical to the installation.

4. A method according to claim 1, comprising providing a chemical resource at a location remote from the installation.

5. A method according to claim 4, wherein the chemical resource is provided at the surface location.

6. A method according to claim 1, further comprising providing a chemical removal channel for removing spent chemicals from the flow battery subsequent to electrical power generation.

7. A method according to claim 6, wherein the chemical removal channel comprises a flowline which carries the spent chemicals to a surface location.

8. A method according to claim 7, wherein the flowline is located within the umbilical cable.

9. A method according to claim 8, wherein the installation is for producing a production fluid, and the flowline transports the production fluid to the surface in use.

10. A method according to claim 1, comprising converting the DC output of the flow battery to AC, and phasing this current with electrical power received at the installation from the umbilical cable.

11. An underwater well installation, the installation being linked to a surface location via an umbilical cable, the installation being provided with means to supplement any electrical power received at the installation from the umbilical cable, said means comprising:

a chemical flow battery at the installation;

a chemical supply channel for supplying the flow battery with operating chemicals for the purpose of electrical power generation, the chemical supply channel comprising a flowline housed within the umbilical cable;

means for supplying the operating chemicals to the flow battery via the chemical supply channel; and an electrical power output line for transferring electrical power generated by the flow battery to the installation, wherein the electrical power generation is caused by a chemical reaction of the operating chemicals.

12. An installation according to claim 11, wherein the chemical supply channel comprises a spare chemical or hydraulic fluid flowline.

13. An installation according to claim 11, wherein the umbilical cable is connected to an umbilical termination assembly, the umbilical termination assembly being linked to the flow battery by a chemical flow line for the supply of operating chemicals thereto.

* * * * *